United States Patent [19]

Stephens

[11] 4,066,324

[45] Jan. 3, 1978

[54] SOLDERLESS COAXIAL CABLE TERMINATOR

[75] Inventor: Gerald D. Stephens, Vandalia, Ohio

[73] Assignee: Valor Enterprises, Inc., West Milton, Ohio

[21] Appl. No.: 767,901

[22] Filed: Feb. 11, 1977

[51] Int. Cl.[2] ..... H01Q 1/50

[52] U.S. Cl. ..... 339/126 J; 174/153 A; 343/715; 343/906

[58] Field of Search ..... 339/177 R, 177 E, 177 L, 339/126 J; 343/715, 900, 901, 906; 174/138 A, 152 A, 153 A

[56] References Cited

U.S. PATENT DOCUMENTS

Re. 23,310 12/1950 Eriksen et al. ..... 174/152 A 2,514,167 7/1950 Scott ..... 343/900

FOREIGN PATENT DOCUMENTS 1,144,080 4/1957 France ..... 343/715

*Primary Examiner*—Roy Lake
*Assistant Examiner*—Neil Abrams

[57] ABSTRACT

A coaxial cable is secured in a curved channel between two body halves. The shield conductor of the cable is passed through one of the body halves to a position compressed against the conductive frame to which the mount is attached. The center conductor is compressed between the other body half and a mounting bolt which supports an antenna socket on the mount, completing the shield and center conductor circuits from the coaxial cable without solder.

11 Claims, 8 Drawing Figures

SOLDERLESS COAXIAL CABLE TERMINATOR

BACKGROUND OF THE INVENTION

This invention relates to a device for rapidly terminating a coaxial cable and completing the electrical connections therefrom. The device may be used for supporting and connecting the cable to an antenna which can be mounted thereon.

Most coaxial cables, while quite effective in carrying signals with minimal losses, are difficult to work with when they must be terminated and electrically connected. The signal carrying center conductor is commonly spaced and insulated from the outer braided ground shield by a foam plastic material which melts easily at low temperatures. Soldering the coaxial cable conductors is thus difficult, since the softened plastic allows the center conductor to short to the braided shield conductor. One solution is to strip a considerable length of the cable to expose a long section of the center conductor, and to solder only the very end thereof, perhaps with a heat sink attached to the center conductor. However, the exposed center conductor must again be protected electrically and supported physically. Further, for maximum efficiency the continuity of the impedence and shielding should be maintained.

Numerous connectors have therefore been designed to reduce as much as possible the need for exposing long lengths of the center conductor and for soldering. These connectors also seek to maintain the continuity of the electrical characteristics as far as possible. Unfortunately, such prior art devices are usually complicated, intricate, difficult to work with, and unnecessarily expensive. Thus, while perhaps suitable for certain specialized applications, they are less than ideal for volume applications such as in connection with citizens band radios.

SUMMARY OF THE INVENTION

Briefly, the present invention provides an inexpensive, highly reliable, easy to use, quick acting coaxial cable terminator which can also mount an antenna and will complete the electrical connections to ground and to the antenna in a positive and reliable manner without the use of heat or solder. Conceptually, the present invention loops the cable through an arc of a half circle or greater within a channel in the mount body to secure the cable physically within the channel and within the mount. The body is in two halves which snap together around the cable. Before the cable is secured in the channel, it is stripped in the customary fashion to expose a portion of the center conductor, and slightly back from the end to expose a portion of the braided shield which is unbraided and formed into a pigtail in the usual fashion. The shield or ground conductor is then passed upwardly and out through a path or hole in the upper body half, and the center conductor is passed downwardly and out thorugh a path or hole in the lower body half. When the two body halves are snapped together around the coaxial cable, the center conductor exits through the bottom and the shield conductor exits through the top.

The frame to which the antenna terminator is to be attached is provided with a hole, the assembled body being located therebeneath. The shield conductor is then positioned between the upper body portion and the conductive frame and secured in that position when the body is secured to the frame. The body is secured to the frame by a bolt which passes through a central opening in the body, then through the hole in the frame, and then into an antenna socket on the opposite side of the frame. When the bolt is tightened into the socket, it secures the entire coaxial cable terminator and antenna mount.

Before the bolt is tightened, the center conductor of the coaxial cable is positioned between the lower body portion and the head of the bolt. A conductive washer may be inserted between them, placing the center conductor in contact with the washer, and through it into electrical contact with the bolt, which in turn completes the electrical circuit to the antenna socket through the bolt as it passes through the center of the body. A boss on the upper body portion and a nylon washer on the antenna socket side of the frame space the body, bolt, and antenna socket from the conductive frame, so that the frame does not short the center conductor circuit. Preferably, the body portions are made of insulating material, but that is not necessary as long as the center conductor circuit to the antenna socket is insulated from the grounded conductive frame.

Thus, when the bolt and antenna socket are tightened, the coaxial cable is secured within the mount body, the shield conductor is held in firm electrical contact with the conductive frame, and the center conductor is held in physical contact with the washer, and thus in electrical contact with the bolt and antenna socket. No heat or solder is required, wide tolerances are afforded, and the assembly and connection can be accomplished easily and quickly.

It is therefore an object of the present invention to provide an improved coaxial cable terminator for supporting and electrically terminating a coaxial cable without solder; which can support and mount an antenna thereon; which can provide a positive and reliable connection of the shield conductor of the coaxial cable to a conductive frame on which the terminator is supported and a similar connection to an antenna socket supported thereon, all without the need for solder; which may be easily and inexpensively fabricated from a minimum number of uncomplicated parts; which has a channel for receiving and grasping the coaxial cable and paths leading from the channel for separately leading the shield and center conductors to locations wherein they are each secured in electrical contact, respectively, with the conductive frame and a signal conductor, such as an antenna socket, by being captured and compressed in electrical contact therewith upon final assembly and tightening of the mount onto the conductive frame; and to accomplish the above objects and purposes in an inexpensive, reliable, easily and rapidly assembled configuration readily suited to mass production and utilization.

Other objects and advantages of the invention will be apparent from the following description, the accompanying drawings and the appended claims.

DESCRIPTION OF THE PREFERRED EMBODIMENT

Figure 1:
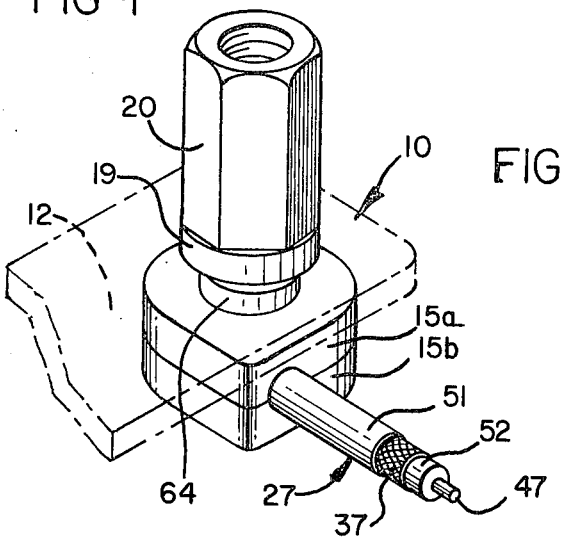
FIG. 1 is a perspective view of the terminator and mount after assembly onto a typical conductive supporting frame, the frame being shown in phantom.
Figure 2:
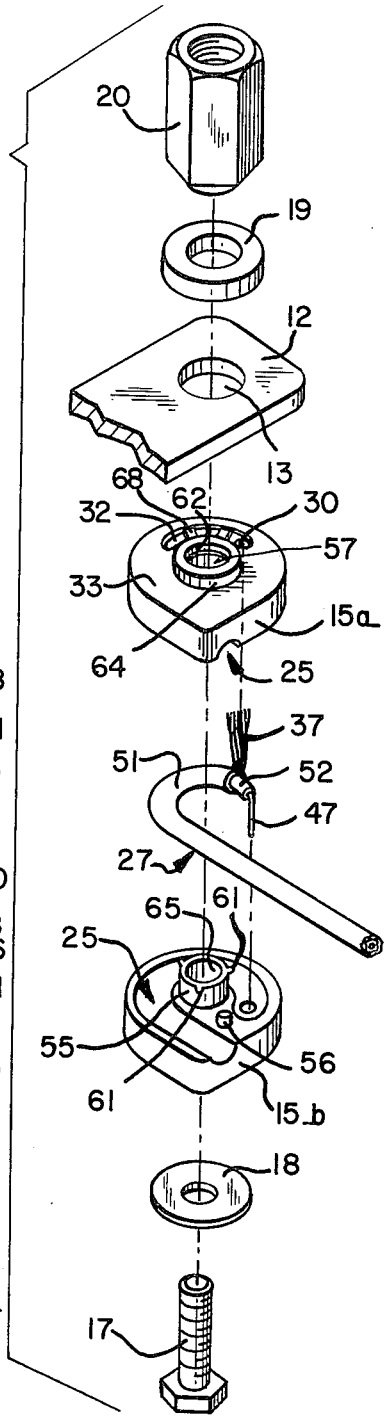
FIG. 2 is a perspective explode of the FIG. 1 device.
Figure 3:
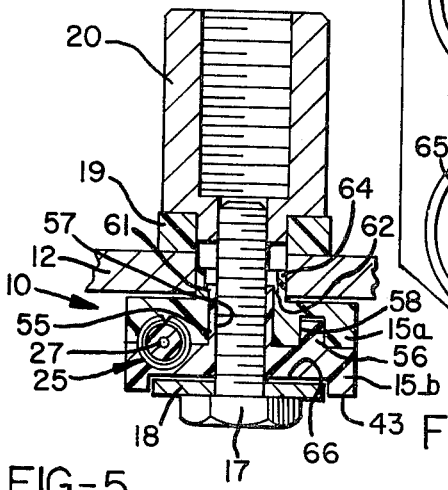
FIG. 3 is a partial cross sectional view through the FIG. 1 device.
Figure 7:
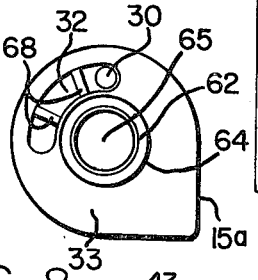
FIG. 7 is a view of the outer or upper face of the upper body portion.

The solderless coaxial cable terminator and antenna mount 10 is designed for attachment to a conductive supporting frame 12 through a suitably sized hole 13. Terminator 10 includes a body 15 which is divided into a first or upper body portion 15*a* and a second or lower body portion 15*b*, a hexagonal bolt 17, a metallic washer 18, an insulating washer 19, and an antenna socket 20. As shown in FIGS. 2 and 3, the device 10 is assembled onto frame 12 with the body portions 15*a* and 15*b* and washer 18 located beneath the frame 12 on one side of hole 13, antenna socket 20 and washer 19 above frame 12 on the opposite side of hole 13, and secured to one another by hex bolt 17 which passes axially through these members and the frame hole 13.

Figure 4:
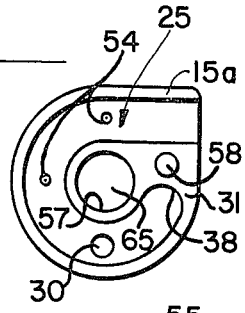
FIG. 4 is a view of the channel and inner faces of the two halves of the body portion of the mount, as it opened in book fashion.
Figure 4:
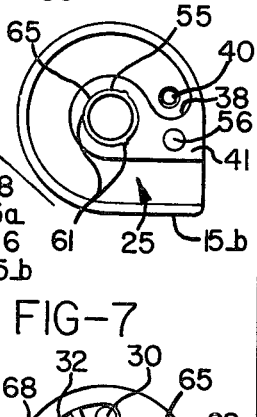

The body portions 15*a* and 15*b* are complementary to one another, as may be seen in FIG. 4, and have channel portions therein which, together, define a channel 25 which is located between the body portions when they are assembled. Channel 25 is shaped to define an arc greater than about 90° and is sized for receiving and physically gripping and securing a coaxial cable 27 therein when the body portions are secured together.

The upper body portion 15*a* has an opening 30 extending from the bottom of the channel 25 on its inner face 31 through to a groove 32 in the upper or outer face 33 of the upper body portion 15*a*. Opening 30 serves as a ground shield opening for providing a path through the upper body portion 15*a* for leading the shield conductor 37 of the coaxial cable 27 from channel 25 to the outer face 33 of the upper body portion 15*a*, for locating the shield conductor 37 in the groove 32. For reasons which will shortly become apparent, the ground shield opening 30 is spaced a short distance, such as ½ inch, from the end 38 of the channel 25.

The lower body portion 15*b* has a similar opening 40 which is located adjacent the end 38 of the channel 25. Opening 40 connects the inner face 41 of body portion 15*b* from the bottom of the channel 25 therein to the lower or outer face 43 thereof. Opening 40 thus provides a path through the lower body portion 15*b* for leading the center conductor 47 of the coaxial cable 27 from the channel 25 to the outer face 43 of the lower body portion 15*b*. Preferably, the upper and lower body portions 15*a* and 15*b* are formed of non-conductive material, such as plastic, so that the shield and center conductors 37 and 47 of the coaxial cable are insulated as they pass through their respective openings 30 and 40 to the outer faces 33 and 43 of the terminator body 15.

When the terminator and mount device 10 is to be assembled, the coaxial cable 27 is stripped and prepared in the customary manner, as illustrated in FIG. 2. That is, a length of the outer insulating jacket 51 is removed from the coaxial cable 27, exposing the braided shield conductor 37 which surrounds an inner spacing and insulating core 52. Conductor 37 is then unbraided and turned upwardly near the cut end of the outer jacket 51 to space it from the end of the center conductor 47. Next a shorter portion of the inner insulating core 52 is removed to expose a length of the center conductor 47. The end of the coaxial cable 27 is then curved to match the shape of channel 25, and the unbraided shield conductor 37 and exposed center conductor 47 are positioned opposite their respective openings 30 and 40. Openings 30 and 40, as previously indicated, are so spaced from the end 38 of channel 25 that the openings are now opposite their respective conductors 37 and 47, for ease in passing the conductors therethrough. The conductors are then simultaneously passed through their respective openings as the cable 27 is laid in channel 25 and the body portions 15*a* and 15*b* are pressed together, in alignment, gripping the cable 27 within the channel. Projections may be included within the channel 25, such as the projections 54 shown on the body portion 15*a* (FIGS. 3–5), to further grip and securely hold the cable 27 within the channel.

To facilitate proper assembly of the body portions 15*a* and 15*b*, one of them, such as the lower body portion 15*b*, has a hollow alignment boss 55 and an indexing post 56 on its inner face 41 for reception in the other body portion in a complementary core opening 57 and indexing hole 58. When properly aligned, therefore, the boss 55 slides into the core opening 57 and the indexing post 56 into hole 58, as shown in FIG. 3. Assembly is further aided by tongues 61 on the ends of boss 55 which snap into place over the edge of a step 62 (FIG. 3) on the inside surface of the core opening 57, the step creating a groove for the tongues 61. When the upper and lower body portions 15*a* and 15*b* are thus assembled, they snap together and are held together by this tongue and groove arrangement.

The upper body portion 15*a* has a hollow locating boss 64 on its outer face 33 which is spaced for reception in the hole 13 of the mounting frame 12. Boss 64 thus aligns and positions the body 15 coaxially with hole 13 on one side (preferably the lower) of frame 12. The hollow cores of the alignment boss 55 and locating boss 64 thus form a central channel 65 through the body 15 through which the hex bolt 17 may pass. Washer 18 is then seated in a recess 66 in the outer face 43 of the lower body portion 15*b*, and the bolt 17 is passed upwardly through it and through channel 65. The bolt is then threaded into a mating portion of a signal conductor, such as the antenna socket 20, as illustrated in FIG. 3. Bosses 55 and 64 space and insulate bolt 17 from the frame 12, and washer 19 is positioned between frame 12 and the antenna socket 20 to space and insulate it from frame 12 as well. Bolt 17 thus finally secures the terminator and mount 10 onto one side of frame 12 as it secures the antenna socket 20 onto the frame and onto body 15 on the opposite side of the frame.

Figure 5:
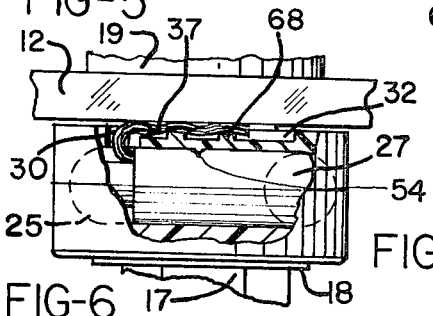
FIG. 5 is a partially broken away side view showing the shield conductor in position between the upper body portion and the conductive frame.
Figure 8:
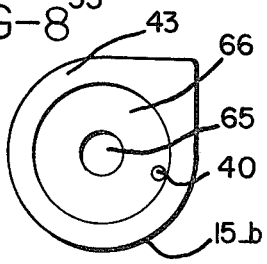
FIG. 8 is a view of the outer or lower face of the lower body portion.

When thus assembled, groove 32 in the outer face 33 of the upper body portion 15 is located and held securely adjacent the frame 12. The shield conductor 37 will then be located between this portion of the upper body portion 15*a* and the conductive frame 12 and is secured therein in contact with the frame for completing the ground circuit thereto. The contact can be further enhanced by pressure ridges 68 in groove 32 for pressing the conductor 37 against frame 12, as illustrated in FIG. 5.

Figure 6:
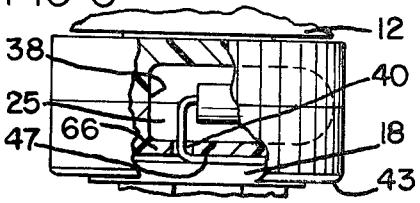
FIG. 6 is a view similar to FIG. 5 but with the body rotated to show the center conductor in position between the lower body portion and the conductive washer which is secured in position by the antenna socket bolt.

When assembled as illustrated in FIG. 6, the hex bolt 17, which secures the antenna socket 20 onto the body portion 15, has its head portion adjacent the recess 66 in the outer face 43 of the lower body portion 15*b*. Bolt 17 and the washer 18 within recess 66 are both made of conductive, metallic materials and are securely held in position in contact with the center conductor 47 of the coaxial cable 27 where conductor 47 exits through opening 40 into recess 66 on the outer face 43 of the lower body portion 15*b*. The center conductor 47, which is thus secured in position between the recess 66 and the head of the bolt 17 (as well as washer 18) is also held in electrical contact, through washer 18 and bolt 17, with the antenna socket 20 for completing the electrical circuit thereto.

As may be seen, therefore, the present invention provides numerous advantages. It is uncomplicated, inexpensive, and readily suited to mass production and convenient mass utilization. It may be quickly and easily assembled without the use of solder or heat, enjoys wide tolerances, and does not require careful sizing or spacing of parts. Once assembled, it is durable and reliable, and it mechanically grasps the coaxial cable to support it against ordinary stresses. While terminating the coaxial cable, it provides for connecting the cable electrically as desired to a signal conductor, such as an antenna socket, a plug, another cable, etc., which could also be supported thereon.

While the form of apparatus herein described constitutes a preferred embodiment of this invention, it is to be understood that the invention is not limited to this precise form of apparatus, and that changes may be made therein without departing from the scope of the invention.

What is claimed is:

1. A solderless coaxial cable terminator for supporting and electrically terminating a coaxial cable on a conductive frame, comprising:

a. a body divided into complementary first and second portions, b. means defining a channel in said body portions for receiving a coaxial cable therein, c. means for securing said body portions to one another and to the conductive frame with a predetermined portion of said first body portion held securely adjacent the frame, d. means forming a path in said first body portion for leading the shield conductor of the coaxial cable from said channel to a position between said predetermined portion of said first body portion and the conductive frame, and for securing the shield conductor in electrical contact with the conductive frame, for completing the ground circuit thereto, e. a signal conductor, f. conductive securing means in electrical contact with said signal conductor and held securely adjacent a predetermined portion of said second body portion, g. means insulating said signal conductor and said conductive securing means from the conductive frame, and h. means forming a path in said second body portion insulated from the conductive frame for leading the center conductor of the coaxial cable from said channel to a position between said predetermined portion of said second body portion and said conductive securing means, and for securing the center conductor in electrical contact with said conductive securing means, for completing the circuit thereto and thence to said signal conductor from the coaxial cable center conductor.

2. The mount of claim 1 further comprising means forming at least one external groove in at least one of said predetermined body portions extending from its respective said path means for receiving one of the coaxial cable conductors.

3. The mount of claim 2 further comprising pressure ridges within said groove for improving the contact between the coaxial cable conductor therein and its respective conductive frame or conductive securing means.

4. The terminator of claim 1 wherein said signal conductor is an antenna socket and said conductive securing means is an antenna socket securing means which secures said antenna socket onto said body.

5. The mount of claim 4 further comprising means forming an opening through the conductive frame and means forming a central channel through said body for receiving and passing said antenna socket securing means therethrough and through said frame opening to provide for locating said body on one side of the conductive frame and said antenna socket on the other side thereof.

6. The mount of claim 5 further comprising means for spacing and insulating said antenna socket and said antenna socket securing means from said opening in said conductive frame.

7. The mount of claim 6 wherein said antenna socket securing means includes a bolt passing through said central body channel and being threaded into said antenna socket, the head of said bolt being adjacent said predetermined portion of said second body portion, and a conductive washer on said bolt disposed between the head of said bolt and said predetermined portion of said second body portion for contacting the center conductor of the coaxial cable and completing the circuit therefrom to said bolt and thence to said antenna socket.

8. The mount of claim 1 further comprising means adapting said channel for gripping and securing the coaxial cable therein when said body portions are secured together.

9. The mount of claim 8 wherein said channel is shaped substantially to define an arc greater than 90° to secure the coaxial cable therein.

10. The mount of claim 1 wherein said means for securing said body portions to one another includes means defining a groove on one of said body portions and tongue means on the other said body portion dimensioned and positioned to snap together and to hole said body portions together when they are pressed together.

11. A solderless coaxial cable terminator and antenna mount for supporting and securing an antenna on a conductive frame and connecting a coaxial cable thereto, comprising:

a. a body formed substantially of insulating material and being divided into complementary first and second portions, b. means defining a channel between said body portions adapted and shaped to define an arc greater than 90° for receiving, gripping, and securing a coaxial cable therein when said body portions are secured together, c. means including a conductive bolt for securing said body portions to one another and to the conductive frame with a predetermined portion of said first body portion held securely against the frame, d. said means for securing said body portions to one another including means defining a groove on one of said body portions and tongue means on the other said body portion dimensioned and positioned to snap together and to hold said body portions together when they are pressed together, e. means forming an opening in said first body portion for leading the shield conductor of the coaxial cable from said channel to a position between said predetermined portion of said first body portion and the conductive frame and for securing the shield conductor between and in contact with said predetermined portion of said first body portion and the conductive frame, for completing the ground circuit thereto, f. an antenna socket, g. means including said conductive bolt in contact with said antenna socket for securing said antenna socket onto said body with the head of said bolt held securely against a predetermined portion of said second body portion, h. means for spacing and insulating said antenna socket and said bolt from the conductive frame, and from said opening therethrough, i. means forming an opening in said second body portion insulated from the conductive frame and spaced from said opening in said first body portion for leading the center conductor of the coaxial cable from said channel to a position between said predetermined portion of said second body portion and said bolt, and for securing the center conductor between and in contact with said predetermined portion of said second body portion and said bolt, for completing the circuit thereto and thence to said antenna socket from the coaxial cable center conductor, j. means forming at least one external groove in at least one of said predetermined body portions extending from its respective said opening for receiving one of the coaxial cable conductors therein, and pressure ridges within said groove for improving the contact between the coaxial cable conductor therein and its respective conductive frame or bolt, k. means forming an opening through the conductive frame and means forming a central channel through said body for receiving and passing said bolt therethrough and through said frame opening to provide for locating said body on one side of the conductive frame and said antenna socket on the other side thereof, said bolt being threaded into said antenna socket and the head of said bolt being adjacent said predetermined portion of said second body portion, and l. a conductive washer on said bolt disposed between the head of said bolt and said predetermined portion of said second body portion for contacting the center conductor of the coaxial cable and completing the circuit therefrom to said bolt and thence to said antenna socket.

* * * * *